US005459647A

United States Patent [19]

Betts

[11] Patent Number: 5,459,647

[45] Date of Patent: Oct. 17, 1995

[54] TRIMMING KNIVES

[75] Inventor: David Betts, Thurgoland, England

[73] Assignee: S. Betts & Sons Limited, Sheffield, United Kingdom

[21] Appl. No.: 244,786

[22] PCT Filed: Oct. 29, 1993

[86] PCT No.: PCT/GB93/02233

§ 371 Date: Jun. 8, 1994

§ 102(e) Date: Jun. 8, 1994

[87] PCT Pub. No.: WO94/09951

PCT Pub. Date: May 11, 1994

[30] Foreign Application Priority Data

Nov. 5, 1992 [GB] United Kingdom ..... 9223202

[51] Int. Cl.[6] ..... B25B 23/18; B26B 11/00

[52] U.S. Cl. ..... 362/119; 362/109; 362/253

[58] Field of Search ..... 7/119, 163; 362/109, 362/119, 208, 253, 120

[56] References Cited

U.S. PATENT DOCUMENTS

| | | | |
|---|---|---|---|
| 1,561,262 | 11/1925 | Martin . | |
| 2,952,025 | 9/1960 | Johnson | 7/14.1 |
| 4,478,330 | 10/1984 | Lin | 206/38 |
| 4,766,673 | 8/1988 | Bolson | 33/138 |
| 4,783,867 | 11/1988 | Tsao | 7/160 |
| 4,794,692 | 1/1989 | Wang | 30/123 |

FOREIGN PATENT DOCUMENTS

| | | |
|---|---|---|
| 306461 | 3/1989 | European Pat. Off. . |
| 2638021 | 3/1978 | Germany . |
| 284158 | 11/1952 | Switzerland . |
| 288909 | 4/1928 | United Kingdom . |

*Primary Examiner*—Stephen F. Husar
*Attorney, Agent, or Firm*—Edwin D. Schindler

[57] ABSTRACT

A trimming knife is disclosed having an elongate body which is tapered from a rounded wider end to a narrower end and which has an end face. A coiled tape measure is housed within the rounded wider end of the elongate body, which has an end portion extendable from a slot formed in the end face. A flashlight is housed in the elongate body and arranged to show from the end face and illuminate the tape measure when the tape measure is extended from the slot. Finally, a blade, or a socket for mounting said blade, is provided in the end face so that a cutting edge of the blade extends alongside and at the level of the tape measure when the tape measure is extended from the slot.

7 Claims, 1 Drawing Sheet

TRIMMING KNIVES

This invention relates to improvements in trimming knives.

A trimming knife comprises generally speaking a handle and a replaceable blade, and may be used among other operations for cutting hard-board, plaster-board and other panels. In carrying out such an operation, it is usually necessary to first use a rule or tape measure and pencil to mark out a cutting line, and then use a straight edge placed along the cutting line to guide the trimming knife in actually making the cut. This involves the provision of at least four different implements (rule, pencil, straight edge [which may or may not be the rule], and knife). Furthermore, if working in poor light, as in an attic, cellar, or space in a building under construction not yet provided with lighting, a third hand is required to hold a torch.

An object of this invention is to enable all or most of these functions to be achieved by using a single tool.

In accordance with the invention, therefore, a trimming knife is provided which has a handle into which is embodied at least an extendable and retractable tape measure.

This measure is preferably extendable and retractable via an orifice adjacent a blade, or a socket for fitting a blade.

The knife handle further preferably has a built-in flashlight positioned to illuminate the area around the blade or blade holding socket.

The handle may enclose a compartment for replacement blades.

Separate finger-operable switches may be provided, one each for extending and/or retracting the blade, locking or unlocking the tape measure, and/or operating the flashlight.

A preferred embodiment of improved trimming knife according to the invention will now be described, by way of example, with reference to the accompanying drawings, wherein.

Figure 1:
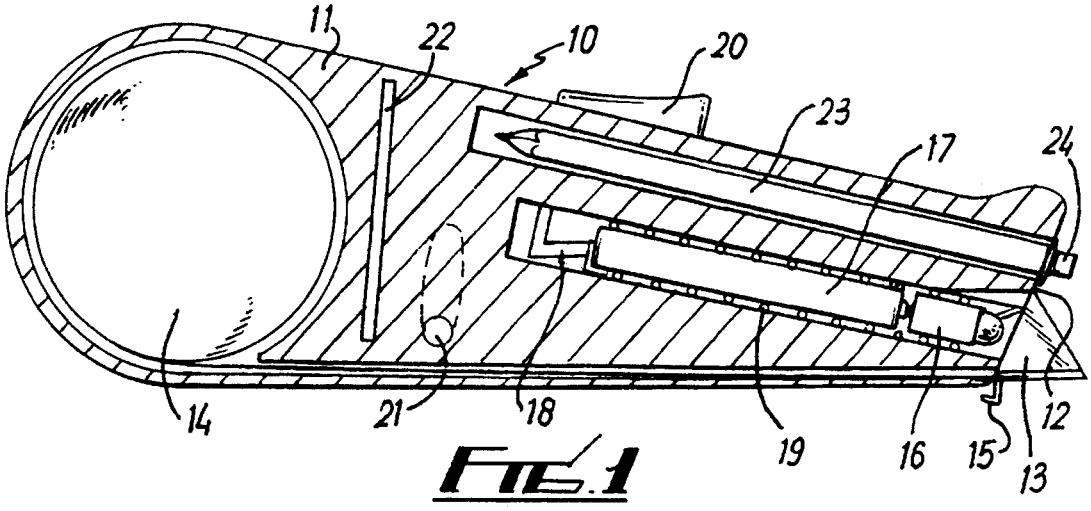
FIG. 1 is a partially sectional side elevation of a trimming knife according to the invention.
Figure 2:
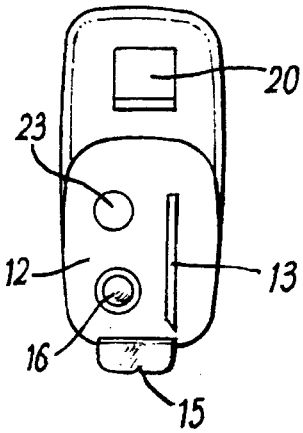
FIG. 2 is a view of the blade end face of the trimming knife.

An improved trimming knife 10 according to the invention includes a handle 11, which is advantageously profiled to be a comfortable fit in a user's hand.

The handle has a narrow end 12 in which is provided a blade-holding socket for a replaceable cutting blade 13. The handle additionally accommodates an extendable and rewindable tape measure 14, with a tang 15 which prevents it from being retracted within the end 12.

In addition, the handle accommodates a flashlight, comprising a small, e.g. 1.25 volt, 250 milli-amp bulb 16 mounted in the end 12 to direct light into the space around the blade 13.

A battery 17, e.g. a 1.5 volt widely obtainable pencil battery LR1 battery is mounted in a space aligned with the bulb 16, and can be moved by a light switch 18 to contact the end of the bulb 16. The circuit is completed by a coil spring 19, one end of which is wrapped about the bulb 16 and the other end having a tail which, when the battery is moved down into contact with the bulb, contacts the rear face of the battery 17.

A sliding switch 20 is provided to extend and retract the blade 13, in known manner, and a further finger lever 21 is provided to lock or unlock the tape 14 for extension and retraction.

Figure 3:
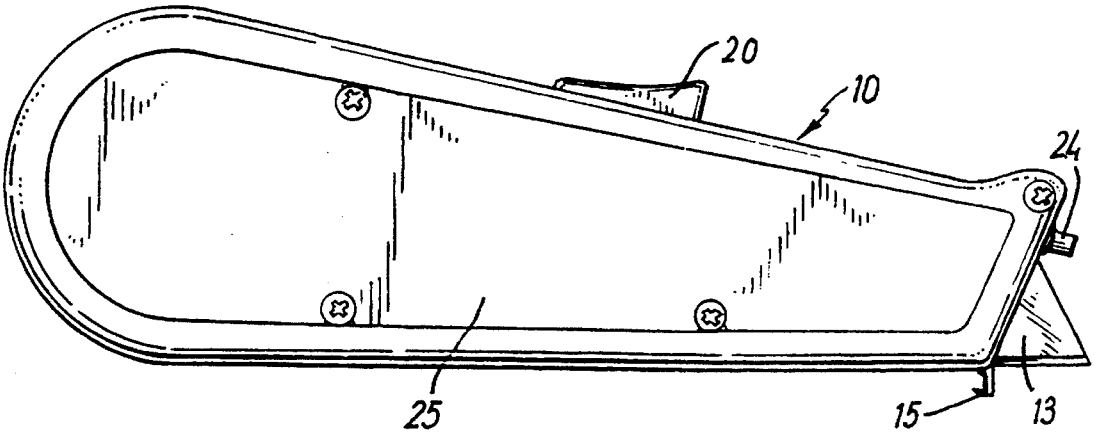
FIG. 3 is a view of the outside casing of the trimming knife.

A pencil 23 with an eraser tip 24 is received in a bore in the handle, adjacent and parallel to the flashlight. As shown in FIG. 3, a panel 25 of white plastics material, which can be marked by the pencil, and cleaned by the eraser, is provided on one side of the handle, for jotting notes.

In use, the tape 14 may be used first to define a cut-line, then serve as a straight edge for guiding the cutting blade 13 thereby removing the necessity for a separate straight-edge, rule, pencil and trimming knife normally used for cutting materials such as plasterboard, cardboard, hardboard etc. All four operations can be carried out by the improved trimming knife tool. The flashlight may be used to illuminate the area about the blade 13, to allow working in darkened areas. A compartment 22 in the butt 23 of the handle 11 is provided to accommodate replacement blades 13.

What is claimed is:

1. A trimming knife, comprising:

an elongate body being tapered from a rounded wider end to a narrower end having an end face;

a coiled tape measure being housed within said rounded wider end and having an end portion extendable from a slot formed in said end face;

a flashlight being housed in said body and arranged to show from said end face and illuminate said tape measure when said tape measure is extended from said slot; and, a blade, or a socket for mounting said blade, provided in said end face so that a cutting edge of said blade extends alongside and at the level of said tape measure when said tape measure is extended from said slot.

2. The trimming knife according to claim 1, wherein said elongate body encloses a compartment for replacement blades.

3. The trimming knife according to claim 1, further comprising separate finger-operable switches for extending or retracting said blade.

4. The trimming knife according to claim 1, further comprising separate finger-operable switches for locking or unlocking said tape measure.

5. The trimming knife according to claim 1, further comprising separate finger-operable switches for operating said flashlight.

6. The trimming knife according to claim 7, further comprising a pencil with an eraser received in a bore in said end face, adjacent and parallel to said flashlight.

7. The trimming knife according to claim 6, further comprising a panel being mounted onto the exterior of said elongate body, said panel being able to be marked by the pencil, and cleaned by the eraser, for jotting notes.

* * * * *